US009704477B2

(12) United States Patent
Zhao et al.

(10) Patent No.: US 9,704,477 B2
(45) Date of Patent: Jul. 11, 2017

(54) TEXT-TO-SPEECH PROCESSING BASED ON NETWORK QUALITY

(71) Applicant: GENERAL MOTORS LLC, Detroit, MI (US)

(72) Inventors: Xufang Zhao, Windsor (CA); Omer Tsimhoni, Ramat Hasharon (IL); Gaurav Talwar, Novi, MI (US)

(73) Assignee: GENERAL MOTORS LLC, Detroit, MI (US)

( * ) Notice: Subject to any disclaimer, the term of this patent is extended or adjusted under 35 U.S.C. 154(b) by 95 days.

(21) Appl. No.: 14/478,716

(22) Filed: Sep. 5, 2014

(65) Prior Publication Data

US 2016/0071509 A1 Mar. 10, 2016

(51) Int. Cl.
*G10L 13/04* (2013.01)
*G07C 5/00* (2006.01)

(52) U.S. Cl.
CPC ..... *G10L 13/04* (2013.01); *G07C 5/008* (2013.01)

(58) Field of Classification Search
None
See application file for complete search history.

(56) References Cited

U.S. PATENT DOCUMENTS 6,952,181 B2 * 10/2005 Karr ..... G01C 21/206 342/450
2002/0184373 A1 * 12/2002 Maes ..... G10L 15/30 709/228
2003/0078986 A1 * 4/2003 Ayres ..... H04L 29/06 709/217
2005/0215260 A1 * 9/2005 Ahya ..... H04W 84/02 455/452.2
2006/0273884 A1 * 12/2006 Watkins ..... G08B 27/00 340/425.5
2007/0005368 A1 * 1/2007 Chutorash ..... B60R 16/0373 704/275
2007/0032225 A1 * 2/2007 Konicek ..... H04M 1/72513 455/417
2008/0177893 A1 * 7/2008 Bowra ..... H04N 21/2401 709/231
2009/0053991 A1 * 2/2009 Mantel ..... G06Q 30/0207 455/3.04
2009/0165046 A1 * 6/2009 Stallings ..... H04N 5/4403 725/39
2009/0287841 A1 * 11/2009 Chapweske ..... H04L 65/4084 709/231

(Continued)

*Primary Examiner* — Pierre-Louis Desir
*Assistant Examiner* — Jonathan Kim
(74) *Attorney, Agent, or Firm* — Leydig, Voit & Mayer, Ltd.

(57) ABSTRACT

A method is disclosed that provides text-to-speech (TTS) functionality to a telematics unit of a telematics-equipped vehicle. The method includes: receiving text content to be played back by an audio system of the telematics-equipped vehicle; determining, by a processor, a TTS rendering process to be used for the text content from a plurality of TTS rendering processes, wherein the plurality of TTS rendering processes include local TTS rendering using a local TTS engine at the telematics-equipped vehicle and remote TTS rendering using a remote TTS engine at a communications center; and causing, by the processor, the text content to be rendered as an audio signal for playback by the telematics-equipped vehicle using the determined TTS rendering process.

12 Claims, 4 Drawing Sheets

(56) References Cited

U.S. PATENT DOCUMENTS

| | | | | |
|---|---|---|---|---|
| 2010/0009696 | A1* | 1/2010 | Fok | H04W 64/00 455/456.1 |
| 2010/0161761 | A1* | 6/2010 | Yu | G06F 15/16 709/219 |
| 2010/0250243 | A1* | 9/2010 | Schalk | G10L 15/22 704/201 |
| 2011/0039508 | A1* | 2/2011 | Lindahl | G06F 1/3203 455/230 |
| 2011/0040981 | A1* | 2/2011 | Lindahl | H04H 20/40 713/189 |
| 2011/0267985 | A1* | 11/2011 | Wilkinson | H04M 1/2535 370/259 |
| 2012/0069131 | A1* | 3/2012 | Abelow | G06Q 10/067 348/14.01 |
| 2012/0253823 | A1* | 10/2012 | Schalk | G08G 1/096877 704/270.1 |
| 2013/0033988 | A1* | 2/2013 | Dhanapal | H04L 12/5692 370/241 |
| 2013/0080173 | A1* | 3/2013 | Talwar | G10L 25/69 704/260 |
| 2013/0185078 | A1* | 7/2013 | Tzirkel-Hancock | G10L 15/22 704/275 |
| 2013/0211832 | A1* | 8/2013 | Talwar | G10L 15/20 704/233 |
| 2013/0285855 | A1* | 10/2013 | Dupray | G01S 19/48 342/451 |
| 2013/0308919 | A1* | 11/2013 | Shaw | H04N 21/2221 386/239 |
| 2014/0019135 | A1* | 1/2014 | Talwar | G10L 13/033 704/260 |
| 2015/0120296 | A1* | 4/2015 | Stern | G10L 15/30 704/236 |
| 2015/0334153 | A1* | 11/2015 | Koster | H04L 65/4069 709/219 |

* cited by examiner

TEXT-TO-SPEECH PROCESSING BASED ON NETWORK QUALITY

BACKGROUND

Telematics units within telematics-equipped mobile vehicles provide subscribers with connectivity to a telematics service provider (TSP). The TSP provides subscribers with an array of telematics services including, for example, call handling, stolen vehicle recovery, emergency notifications, diagnostics monitoring, infotainment services, and satellite-based navigation services. For many of these telematics services, the telematics unit communicates with servers of a TSP call center over a wireless network.

Users of the telematics units of mobile vehicles are often driving or riding in a moving vehicle, and the users of the telematics units generally rely on delivery of voice commands to the telematics unit. The telematics unit similarly communicates with the users using audio feedback, often in the form of speech generated by a text-to-speech (TTS) engine of the telematics unit. For example, a user may issue a simple voice command to the telematics unit (e.g., "call [contact]"), and the telematics unit may respond with a short confirmation using the local TTS engine (e.g., "calling [contact]"). In another example, the user receives a text message via the telematics unit and chooses to have the content of the text message played back as an audio signal by the telematics unit, which uses the local TTS engine to convert text content of the text message into an audio format for playback by the vehicle.

A shortcoming of these conventional telematics systems is that the local TTS engine of the telematics unit tends to be limited in terms of memory, and thus is limited with respect to the level of speech quality is able to be achieved by the local TTS engine. Particularly for relatively long text content (e.g., involving complete and/or compound sentences), audio renderings generated by the local TTS engine may sound awkward, robotic, or unintelligible to the listener.

SUMMARY

Implementations of the invention provide for adaptable text-to-speech (TTS) rendering provided via a distributed TTS system including a local TTS engine on a telematics-equipped vehicle and a remote TTS engine on a remote server. Based on several considerations, including the parameters of a message to be rendered, current and/or future quality of service (QoS) information regarding a network connection, cost considerations, etc., the implementations of the invention provide for different manners in which TTS-rendered speech is delivered to a user of a telematics unit of a vehicle.

In a particular exemplary implementation, the invention provides text-to-speech (TTS) functionality to a telematics unit of a telematics-equipped vehicle using a method, the method including: receiving text content to be played back by an audio system of the telematics-equipped vehicle; determining, by a processor, a TTS rendering process to be used for the text content from a plurality of TTS rendering processes, wherein the plurality of TTS rendering processes include local TTS rendering using a local TTS engine at the telematics-equipped vehicle and remote TTS rendering using a remote TTS engine at a communications center; and causing, by the processor, the text content to be rendered as an audio signal for playback by the telematics-equipped vehicle using the determined TTS rendering process.

BRIEF DESCRIPTION OF THE SEVERAL VIEWS OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION

An exemplary computing and network communications environment involving a telematics-equipped vehicle is described with reference to FIG. 1. It will be appreciated that the described environment is an example, and does not imply any limitation regarding the use of other environments to practice the invention.

Figure 1:
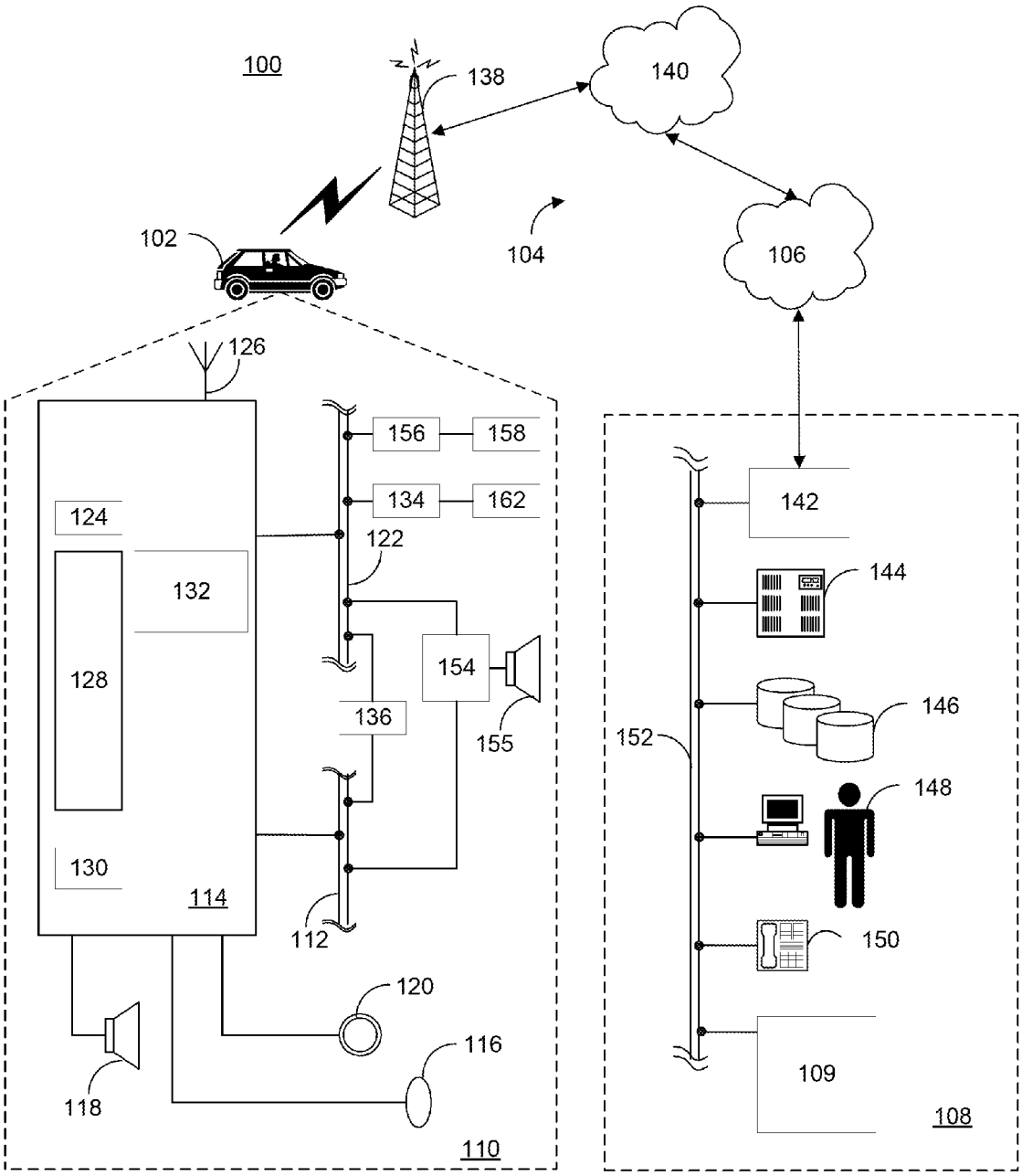
FIG. 1 is a schematic diagram of an operating environment for a mobile vehicle communication system usable in exemplary implementations of the described principles.

FIG. 1 depicts an exemplary communication system 100 that may be used with exemplary implementations of the invention, the communication system 100 including a vehicle 102, a mobile wireless network system 104, a land network 106 and a communications center 108. It should be appreciated that the overall architecture, setup and operation, as well as the individual components of the communication system 100 are generally known in the art. In accordance with an illustrative example, the communication center 108 includes a Global Navigation Satellite System (GNSS) control center 109 incorporating functional components facilitating over-the-air configuration of GNSS receivers integrated with/within telematics units such as a telematics unit 114.

The vehicle 102 is, for example, a motorcycle, a car, a truck, a recreational vehicle (RV), a boat, a plane, etc. The vehicle 102 is equipped with suitable hardware and software that configures/adapts the vehicle 102 to facilitate communications with the communications center 108 via wireless communications (e.g., over a cellular wireless network). The vehicle 102 includes hardware 110 such as, for example, the telematics unit 114, a microphone 116, a speaker(s) 118 and buttons and/or controls 120, which may be integrated with or separate from the telematics unit 114.

The telematics unit 114 is communicatively coupled, via a hard wire connection and/or a wireless connection, to a vehicle bus 122 for supporting communications between electronic components within the vehicle 102. Examples of suitable network technologies for implementing the vehicle bus 122 in-vehicle network include a controller area network (CAN), a media oriented system transfer (MOST), a local interconnection network (LIN), an Ethernet, and other appropriate connections such as those that conform with known ISO, SAE, and IEEE standards and specifications.

The telematics unit 114 provides a variety of telematics-related services through communications with the communications center 108 (or "call center"). The telematics unit 114 includes a processor 128, memory 130, a mobile wireless component 124 including a mobile wireless chipset, a dual function antenna 126 (both GNSS and mobile wireless signals), and a GNSS component 132 including a GNSS chipset. The memory 130 comprises computer program(s) and/or set(s) of computer-executable instruction sets/routines that are transferred to, and executed by, the processing device 128. In one example, the mobile wireless component 124 comprises an additional memory having stored thereon other computer program(s) and/or set(s) of computer-executable instruction sets/routines that are executed by the processing device 128. The mobile wireless component 124 constitutes a network access device (NAD) of the telematics unit 114.

The telematics-related services may also be provided via the communications center 108 in combination with applications executed on a mobile device, such as a smartphone, or, alternatively, via communications between the telematics unit 114 and a mobile device that do not involve the communications center 108.

The telematics-related services include an extensive and extendable set of services. Examples of such services include: GNSS-based mapping/location identification, turn-by-turn directions and other navigation-related services provided in conjunction with the GNSS component 132; and airbag deployment notification and other emergency or roadside assistance-related services provided in connection with various crash and or collision sensor interface modules 156 and crash sensors 158 located throughout the vehicle.

GNSS navigation services are, for example, implemented based on the geographic position information of the vehicle provided by the GNSS component 132. A user of the telematics unit 114 enters a destination, for example, using inputs associated with the GNSS component 132, and a route to a destination may be calculated based on the destination address and a current position of the vehicle determined at approximately the time of route calculation. Turn-by-turn (TBT) directions may further be provided on a display screen corresponding to the GNSS component and/or through vocal directions provided through a vehicle audio component 154. It will be appreciated that the calculation-related processing may occur at the telematics unit or may occur at a communications center 108.

The telematics unit 114 also supports infotainment-related services whereby music, Web pages, movies, television programs, video games and/or other content is downloaded by an infotainment center 136 operatively connected to the telematics unit 114 via the vehicle bus 122 and an audio bus 112. In one example, downloaded content is stored for current or later playback.

The above-listed services are by no means an exhaustive list of the current and potential capabilities of the telematics unit 114, as should be appreciated by those skilled in the art. The above examples are merely a small subset of the services that the telematics unit 114 is capable of offering to users. For example, other service include but are not limited to: vehicle door unlocking, diagnostic monitoring, firmware/software updating, emergency or theft-related services, etc. Moreover, the telematics unit 114 may include a number of known components in addition to those explicitly described above.

The telematics unit 114 may establish a communications channel with the mobile wireless network system 104, for example using radio-based transmissions, so that both voice and data signals can be sent and received via the communications channel. In one example, the mobile wireless component 124 enables both voice and data communications via the mobile wireless network system 104. The mobile wireless component 124 applies encoding and/or modulation functions to convert voice and/or digital data into a signal transmitted via the dual function antenna 126. Any suitable encoding or modulation technique that provides an acceptable data rate and bit error can be used. The dual function antenna 126 handles signals for both the mobile wireless component 124 and the GNSS component 132.

The microphone 116 provides the driver or other vehicle occupant with a way to input verbal or other auditory commands, and can be equipped with an embedded voice processing unit utilizing human/machine interface (HMI) technology. The speaker(s) 118 provides verbal output to the vehicle occupants and can be either a stand-alone speaker specifically dedicated for use with the telematics unit 114 or can be part of an audio component 154. In either case, the microphone 116 and the speaker(s) 118 enable the hardware 110 and the communications center 108 to communicate with occupants of the vehicle 102 through audible speech.

The hardware 110 also includes the buttons and/or controls 120 for enabling a vehicle occupant to activate or engage one or more components of the hardware 110 within the vehicle 102. For example, one of the buttons and/or controls 120 can be an electronic push button used to initiate voice communication with the communications center 108 (whether it be live advisors 148 or an automated call response system). In another example, one of the buttons and/or controls 120 initiates/activates emergency services supported/facilitated by the telematics unit 114. In certain implementations, the buttons and/or controls 120 may include a touchscreen which acts both as a display and as an input interface.

The audio component 154 is operatively connected to the vehicle bus 122 and the audio bus 112. The audio component 154 receives analog information via the audio bus, and renders the received analog information as sound. The audio component 154 receives digital information via the vehicle bus 122. The audio component 154 provides AM and FM radio, CD, DVD, and multimedia functionality independent of or in combination with the infotainment center 136. The audio component 154 may contain an additional speaker system 155, or may utilize the speaker(s) 118 via arbitration on the vehicle bus 122 and/or the audio bus 112.

The vehicle crash and/or collision detection sensor interface 156 is operatively connected to the vehicle bus 122. The crash sensors 158 provide information to the telematics unit 114 via the crash and/or collision detection sensor interface 156 regarding the severity of a vehicle collision, such as the angle of impact and the amount of force sustained.

A set of vehicle sensors 162, connected to various ones of a set of sensor interface modules 134 are operatively connected to the vehicle bus 122. Examples of the vehicle sensors 162 include but are not limited to gyroscopes, accelerometers, magnetometers, emission detection and/or control sensors, and the like. Examples of the sensor interface modules 134 include ones for power train control, climate control, and body control.

The wireless network system 104 is, for example, a cellular telephone network system or any other suitable wireless system that transmits signals between mobile wireless devices, such as the telematics unit 114 of the vehicle 102, and may further include land networks, such as the land network 106. In the illustrative example, the mobile wireless network system 104 includes a set of cell towers 138, as well as base stations and/or mobile switching centers (MSCs) 140, as well as other networking components facilitating/supporting communications between the mobile wireless network system 104 with the land network 106. For example, the MSCs 140 may include remote data servers.

As appreciated by those skilled in the art, the mobile wireless network system includes various cell tower/base station/MSC arrangements. For example, a base station and a cell tower could be located at the same site or they could be remotely located, and a single base station could be coupled to various cell towers or various base stations could be coupled with a single MSC, to name but a few of the possible arrangements.

Land network 106 can be, for example, a conventional land-based telecommunications network connected to one or more landline end node devices (e.g., telephones) and connects the mobile wireless network system 104 to the communications center 108. For example, land network 106 includes a public switched telephone network (PSTN) and/or an Internet protocol (IP) network, as is appreciated by those skilled in the art. Of course, one or more segments of the land network 106 can be implemented in the form of a standard wired network, a fiber or other optical network, a cable network, wireless networks such as wireless local networks (WLANs) or networks providing broadband wireless access (BWA), or any combination thereof.

The communications center 108 is configured to provide a variety of back-end services and application functionality relating to the vehicle hardware 110. The communications center 108 includes, by way of example, network switches 142, servers 144, databases 146, live advisors 148, as well as a variety of other telecommunications equipment 150 (including modems) and computer/communications equipment known to those skilled in the art. These various call center components are, for example, coupled to one another via a network link 152 (e.g., a physical local area network bus and/or a wireless local network, etc.). Switch 142, which may be a private branch exchange (PBX) switch, routes incoming signals so that voice transmissions are, in general, sent to either the live advisors 148 or an automated response system, and data transmissions are passed on to a modem or other component of the telecommunications equipment 150 for processing (e.g., demodulation and further signal processing).

The telecommunications equipment 150 includes, for example, an encoder, and can be communicatively connected to various devices such as the servers 144 and the databases 146. For example, the databases 146 comprise computer hardware and stored programs configured to store subscriber profile records, subscriber behavioral patterns, and other pertinent subscriber information. Although the illustrated example has been described as it would be used in conjunction with a manned version of the communications center 108, it will be appreciated that the communications center 108 can be any of a variety of suitable central or remote facilities, which are manned/unmanned and mobile/fixed facilities, to or from which it is desirable to exchange voice and data.

The telematics unit 114 and communications center 108 further supports text-to-speech (TTS) functionality associated with various telematics services, for example using a local TTS engine implemented as part of the telematics unit 114 and/or using a remote TTS engine implemented as part of the servers 144 and databases 146. The local TTS engine at the telematics unit, which has limited memory and/or processing resources available to it, is well-suited for rendering audio for text content with short syntax (e.g., understanding spoken user controls, providing menu prompts or confirmations over the vehicle speakers, etc.), while the remote TTS engine, which has greater memory and/or processing capabilities, is well-suited for rendering audio for text content having longer syntax (e.g., in the off-board navigation context where turn-by-turn directions are sent to the telematics unit from the communications center, or in other contexts involving complete sentences and more nuanced audio rendering such as playing back rendered news articles, emails, etc.). It will be appreciated that, while the local TTS engine and remote TTS engine are called "text-to-speech" engines, the local TTS engine and remote TTS engine may be capable of both "text-to-speech" operations as well as speech-to-text operations (e.g., relating to recognition of voice input provided by a user).

It will be appreciated by those of skill in the art that the execution of the various machine-implemented processes and steps described herein may occur via the computerized execution of computer-executable instructions stored on a tangible computer-readable medium, e.g., RAM, ROM, PROM, volatile, nonvolatile, or other electronic memory mechanism. Thus, for example, operations performed by computing devices and/or components thereof (such as the telematics unit, communications center equipment, local TTS engine, remote TTS engine, etc.) may be carried out according to stored instructions and/or applications installed on the corresponding computing devices and/or components.

Figure 2:
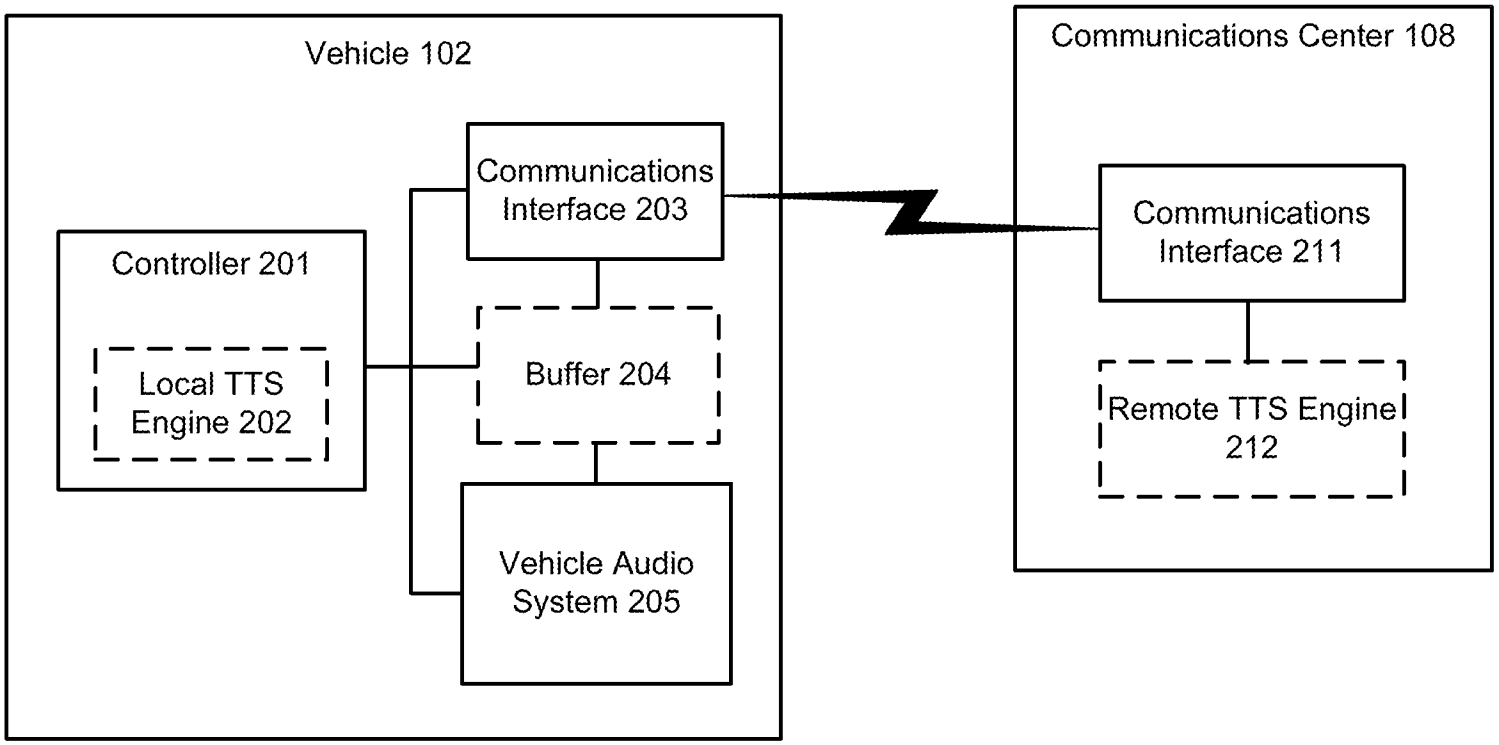
FIG. 2 is a simplified diagram illustrating components of a vehicle and a communications center in accordance with exemplary implementations of the described principles.

FIG. 2 is a simplified block diagram illustrating exemplary components of a vehicle 102 and communications center 108 involved in TTS processing according to various implementations of the invention. The vehicle 102 includes a controller 201 (e.g., implemented by a processor and a memory of a telematics unit), that facilitates TTS processing utilizing a communications interface 203 of the vehicle (e.g., a network access device of the telematics unit), a buffer 204 (e.g., a memory component associated with the telematics unit for storing data received via communications interface 203 for audio playback), and a vehicle audio system 205 (e.g., including in-vehicle speakers). The local TTS engine 202 is implemented as part of the controller 201, and the local TTS engine 202 provides audio rendering and/or audio recognition functions carried out locally for the vehicle. The communications interface 203 is configured to communicate wirelessly with a communications interface 211 of the communications center 108. A remote TTS engine 212 is implemented on server(s) and database(s) provided at the communications center 108, and the remote TTS engine provides audio rendering and/or audio recognition functions carried out remotely.

Using the local TTS engine 202 and/or the remote TTS engine 212, several different TTS processing pathways and manners of TTS processing are possible.

Local TTS Processing: Text content generated at the vehicle 102 or received at the vehicle (e.g., from the communications center 108 or from other sources) is converted to audio signals by the local TTS engine 202 and played back by the vehicle audio system 205.

Remote TTS Processing (streaming playback): Text content generated at the communications center 108 or received at the communication center 108 (e.g., from the vehicle 102 or from other sources) is converted to audio signals by the remote TTS engine 212. The audio signals are transmitted to the vehicle via communications interface 203 and played back immediately by the vehicle audio system 205, for example, without storing the audio signals to the buffer 204 prior to playback. However, it will be appreciated that the buffer 204 may be used to store the audio signals (e.g., for storing audio signals for future playback when the data transmission is faster than the playback rate) in streaming playback mode.

Remote TTS Processing (delayed playback): Text content generated at the communications center 108 or received at the communication center 108 (e.g., from the vehicle 102 or from other sources) is converted to audio signals by the remote TTS engine 212. The audio signals are transmitted to the vehicle via communications interface 203, but playback of the audio signals is delayed by an appropriate amount of time to allow a portion of the audio signals to be stored in the buffer 204 prior to playback.

With respect to speech-to-text processing, similar processing pathways may be used (except that the vehicle audio system 205 may be substituted with a vehicle display or other suitable vehicle component that requires text-based information). Additionally, for speech-to-text, it will be appreciated that typically buffering is not be needed. In instances where the remote TTS engine 212 is used to generate text information from audio signals (the audio signals being received from the vehicle 102 or other sources or generated by the communication center 108), a buffer 204 is typically not used, and the text information is processed by the appropriate vehicle components without the need for buffering (the text information may simply be directly written to a memory as a complete chunk or file). In other instances, where remote speech-to-text functionality is not needed, the local TTS engine is used to generate text information from audio signals.

Figure 3:
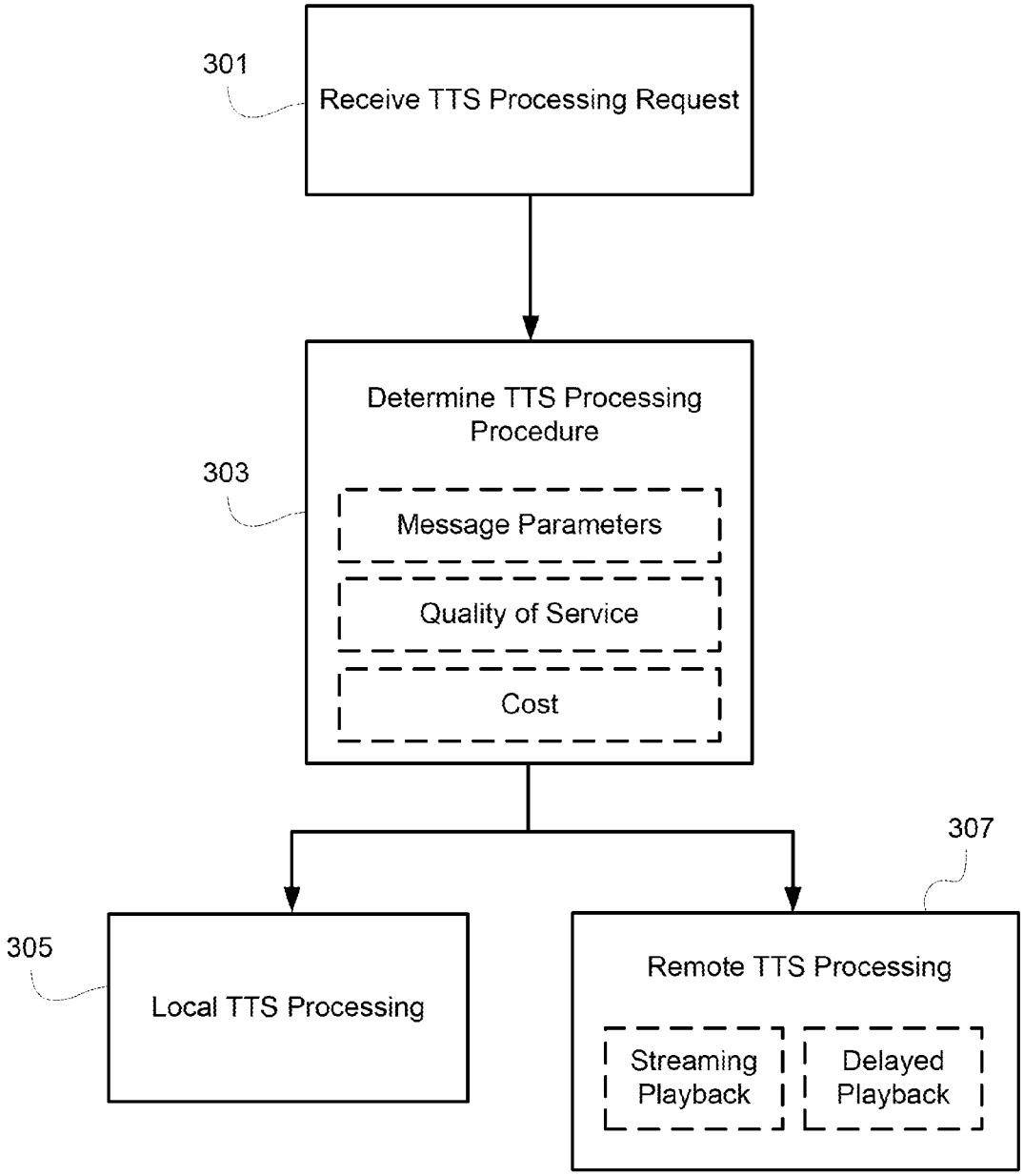
FIG. 3 is a flowchart illustrating an exemplary process for providing TTS services in accordance with exemplary implementations of the described principles.

FIG. 3 illustrates a flowchart illustrating an exemplary process for determining whether local TTS processing, remote TTS processing with streaming playback, or remote TTS processing with delayed playback is to be used according to exemplary implementations of the invention. The determination may be made by a telematics unit of the vehicle, e.g., where the TTS processing request originates from the vehicle or by a communications center, e.g., where the TTS processing request originates from the communications center. In certain exemplary implementations, both entities may be involved: for example, the vehicle may first determine that remote TTS processing should be performed and sends a TTS processing request to the communications center, and the communication center overrides that determination and instructs the vehicle to handle the TTS processing locally.

In any event, the process of FIG. 3 begins at stage 301 with a TTS processing request, for example, where the telematics unit or the communication center is presented with text content that is to be converted to audio signals and played back via a vehicle audio system. Based on text content-related parameters, current or expected future quality of service (QoS) parameters, and/or cost-related parameters, a TTS processing procedure is determined at stage 303. In response to the determination, either local TTS processing is performed at stage 305 or remote TTS processing is performed at stage 307 (whether via streaming playback or delayed playback). With respect to remote TTS processing at stage 307, additional aspects of the playback options (streaming playback or delayed playback) may be modified further, for example, including the time at which streaming playback is to begin or the amount of time to use as the delay for delayed playback.

In various exemplary implementations, the determination of how a TTS processing request is to be handled at stage 303 is based on one or more of a plurality of considerations, including the message parameters, QoS, and cost.

Message Parameters: Different messages may be processed differently based on the parameters of the message—for example, including message type, length, file size, sentence length/structure, word length, etc. In one particular example, text content of a type associated with telematics-related menu prompts are set to always be processed by a local TTS engine at a vehicle telematics unit, while text content of a type associated with e-mail or Internet articles are set to always be processed by a remote TTS engine. Further, by using a semantic classifier, it is possible to classify the topic or context of text content (e.g., as an "Email Message," "Navigation Maneuver," etc.) such that a decision may be made whether to use audio rendering via the local or remote TTS engine based thereon. In another example, text content having special characters, or text content formatted a special way (e.g., using hashtags or other symbols to connote particular meanings), is set to be processed by the remote TTS engine.

Quality of Service: TTS processing requests may be handled different based on the QoS associated with a corresponding vehicle's current position. For example, if the user is in an area having poor QoS or no connectivity at all, the appropriate TTS controller (of the telematics unit or communications center) determines that text content is to be rendered using the local TTS engine, but if the vehicle is in an area having a good or excellent level of QoS, the processor determines that the text content is to be rendered as audio signals using the remote TTS engine in streaming playback mode (where playback for remotely rendered audio content received by the vehicle begins immediately), or if the vehicle is in an area having a fair level of QoS, the processor determines that the text content is to be rendered as audio signals using the remote TTS engine in delayed playback mode (with remotely rendered audio content received by the vehicle over a network being buffered prior to beginning playback). The amount of the audio content to be buffered may depend specifically on the data transfer rate available to the vehicle (e.g., a longer buffering time may be needed where the data transfer rate is low), so as to avoid clips in audio renderings. The level of QoS associated with the current position of the vehicle may be determined based on a current signal strength of the current connection the vehicle telematics unit has with a network, or may be based on looking up the vehicle's position relative to a network connectivity map that includes indications of various levels of QoS associated with different geographic regions. In an example, the QoS map may be maintained at a remote server by a network provider or at the communications center, and the QoS map data may be queried by the vehicle or communications center with respect to the vehicle's current position (or future position as discussed in further detail below). The QoS map data may be based on a-priori knowledge available to the network or telematics service providers, may be based on aggregated data collected from vehicles traversing various geographic regions, and/or a combination thereof.

The level(s) of QoS associated with future expected position(s) of the vehicle may also be considered if the vehicle is traveling according to a specified route or an otherwise known route (e.g., a route often traversed by the vehicle, for example, from a home location to a work location), for example, based on remote QoS map data or based on past QoS information obtained by and stored at the vehicle regarding QoS corresponding to those geographic regions. The determination of how to process a TTS request may thus include consideration of not only the current level of QoS available to the vehicle, but also future expected levels of QoS available to the vehicle. For example, if the vehicle is about to travel from an area of poor QoS to an area of good/excellent QoS, the appropriate controller determines that, instead of using local TTS processing, remote TTS processing with streaming playback is to be used, with a start time for streaming playback to begin when the vehicle enters the region of good/excellent QoS. In another example, the vehicle is currently in an area with good/excellent QoS but is about to travel to an area of fair QoS; in this situation, the appropriate controller determines that, instead of using remote TTS processing with streaming playback, remote TTS processing with delayed playback is to be used, and the appropriate controller causes the vehicle to begin buffering remotely rendered audio content without beginning playback of that content. In yet another example, with regard to the turn-by-turn navigation guidance context, if QoS is expected to be poor later in a route but is relatively higher at earlier stages in the route, the navigation instructions for the poor QoS areas of the route may be remotely rendered and downloaded to the buffer of the vehicle in advance of reaching those poor QoS areas of the route.

Cost: TTS processing requests may also be handled different based on various cost considerations. For example, a telematics subscriber that does not wish to consume network data for TTS purposes may set a user preference (for example, using an Internet application via a personal computer or smartphone) to use local TTS processing only for all TTS-related services. In another example, a telematics subscriber that does not wish to incur roaming fees for consuming network data on a remote network may set a user preference to use local TTS processing when roaming, and cause remote TTS processing to be disabled when the vehicle is in locations that would cause roaming charges to accrue (regardless of how high the QoS in that region may be). In yet another example, where a telematics subscriber has a maximum allotment of data transfer over a billing period (e.g., 1 GB over a month), the controller may intelligently determine whether to use local TTS processing (to conserve the subscriber's resources) or to use remote TTS processing (where exhaustion of bandwidth is not a concern), for example, based on the rate of data usage for that subscriber for that month and/or based on the subscriber's past data usage patterns. In yet another example, when the vehicle is in an area under congested network conditions, local TTS processing may be used or a start time for remote TTS processing may be pushed back to alleviate network crowding. This may be automatically performed by the controller in accordance with detected network conditions, or may be a preference selectable by a telematics subscriber, for example, as a part of a cost-reduction incentive program for reducing network crowding.

Similar to the foregoing discussing regarding QoS considerations, the determination of how to perform TTS processing may further be based on cost considerations associated with future expected position(s) of the vehicle, for example, based on a network connectivity map indicating locations of network congestion and roaming locations. For example, based on the network connectivity map, a vehicle may currently be in a roaming or congested area but expected to enter a non-roaming or uncongested area shortly. In this situation, rather than using local TTS processing in the roaming area, the controller may decide to use remote TTS processing beginning when the vehicle enters the non-roaming or uncongested area (with the decision of whether to utilize a streaming playback mode or delayed playback mode being made based on the QoS associated with the non-roaming area). In yet another example, rather than simply blocking data transfer in roaming areas, the expected data usage in the roaming area is evaluated within a cost function to assess whether such roaming data usage is within an acceptable range for the subscriber.

Each of the foregoing considerations relating to message parameters, QoS, and cost may be combined using decision trees and/or quantitative functions implemented in the programming logic of a controller to determine how to address each situation. For example, based on message parameters (which may include a function weighting various aspects of the text content of a message), or cost-related/QoS-related constraints (e.g., logical conditions where local TTS processing is to be used, for example, according to user preferences or lack of connectivity), the decision between using local TTS processing versus remote TTS processing may be made. And, if remote TTS processing is selected, the decision as to whether to use streaming playback or delayed playback may be further based on the level of QoS associated with current or expected future positions of the vehicle. In further implementations, choosing between various TTS processing methods may further be based on user feedback (for example, if local TTS rendering produces an unsatisfactory result, the user of the telematics unit may input a command or a response that causes the text content to be remotely rendered instead).

Figure 4:
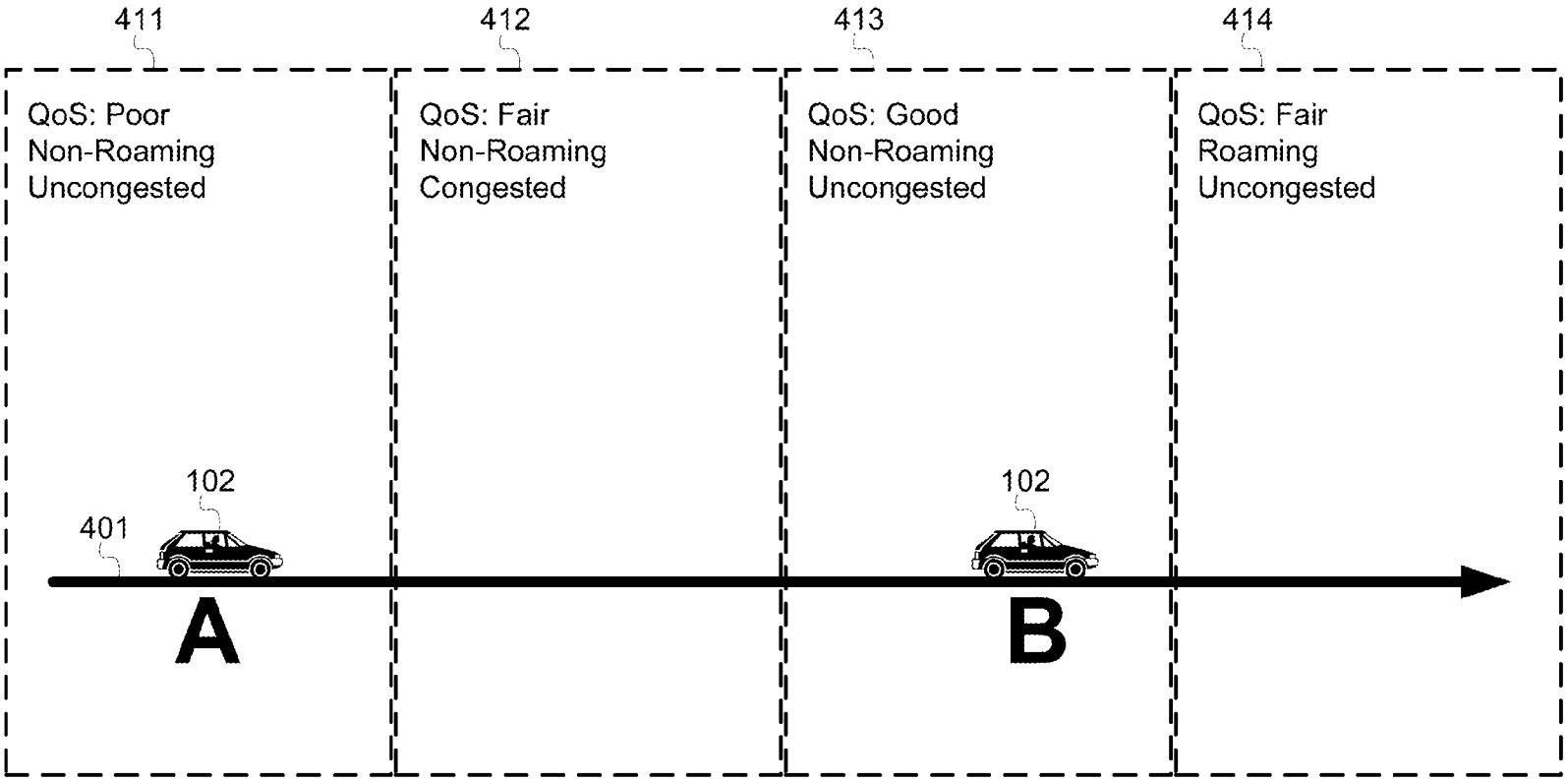
FIG. 4 is a diagram illustrating an exemplary route traversed by a vehicle and various geographic regions associated with the route having different network connectivity-related parameters.

FIG. 4 provides an exemplary illustration of a vehicle 102 traversing a specified route 401, with exemplary points on the route being labeled A and B, and with different regions (411-414) corresponding to network connectivity data indicated by a network connectivity map being overlaid on the route 401. The vehicle begins in a region 411 having poor QoS with non-roaming and uncongested network conditions, travels to a region 412 having fair QoS with non-roaming and congested network conditions, then travels to a region 413 having good QoS with non-roaming and uncongested network conditions, and finally travels to a region 414 having fair QoS with roaming and uncongested network conditions.

In an example, at point A, a user of a telematics unit at vehicle 102 requests a lengthy e-mail to be played using the vehicle's audio system. The controller of the telematics unit determines that the current network conditions in region 411 are not suitable for remote TTS processing because of the poor QoS level and that the vehicle will soon enter region 412 where the QoS level is fair, and determines that remote TTS processing with delayed playback is to be used, and the remote TTS processing with delayed playback begins when the vehicle enters region 412, with the text content being sent to a remote TTS engine at a communications center, and remotely rendered audio signals being received and buffered at the vehicle based thereon.

Alternatively, the telematics subscriber associated with the vehicle 102 may have indicated a user preference to include data transfer to a minimum in congested networks, and as such, remote TTS processing is not available to the vehicle 102 in region 412. In this situation, the controller of the telematics unit may determine that remote TTS processing (with streaming playback) should be started when the vehicle enters region 413 or may choose to render the e-mail message using the local TTS engine while the vehicle is still in regions 411 and/or 412. In one particular example, the telematics unit may provide a choice to the user of the vehicle or may automatically make the determination based on message parameters (e.g., whether the e-mail that it is urgent or not).

In another example, at point B, a user of the telematics unit at vehicle 102 within region 413 requests a relatively short text message to be played using the vehicle's audio system (or a text message is received by the telematics unit and the telematics unit automatically determines that it is to be played according to the subscriber's preferences). The controller of the telematics unit determines that the text message is to be processed remotely with streaming playback, and the remotely-rendered audio content is played back before the vehicle enters region 414.

In yet another example, at point B, a user of the telematics unit at vehicle 102 within region 413 requests a relatively long e-mail message to be played using the vehicle's audio system. The controller of the telematics unit or the controller of the communications center determines that the text content of the e-mail message cannot be fully rendered and streamed by the vehicle before the vehicle enters region 414. Given that the subscriber has indicated a preference not to allow data transfer in roaming areas, the controller decides that the entire e-mail message is to be rendered and played back locally using the local TTS engine. Alternatively, the controller may decide to utilize remote TTS processing with streaming playback up to the point that the vehicle enters region 414, at which point the TTS processing switches over to local TTS processing. Or, further alternatively, the controller decides to used remote TTS processing with delayed playback and buffers a portion of the rendered audio content prior to entering region 414, with buffering to be continued and playback to begin when the vehicle enters a non-roaming region with a QoS level of fair or better.

It will be appreciated that the examples discussed above are merely exemplary, and that various other exemplary TTS processing decisions are possible in accordance with implementations of the invention.

Further implementations of the invention include implementations where local TTS rendering is omitted, and every TTS process that occurs with respect to a vehicle is performed by a remote TTS engine at a communications center. In these implementations, stage 305 from FIG. 3 is omitted, and the determination of stage 303 relates to whether remote TTS processing with streaming playback versus remote TTS processing using delayed playback, as well as further relating to other parameters associated therewith (e.g., start times or start locations for streaming playback or the buffering of delayed playback; an amount of data to buffer, etc.).

Additionally, even though the implementations discussed herein pertain specifically to TTS processing, it will be appreciated that principles of the invention, for example, the utilization of a network connectivity map indicating QoS and other network-related parameters, may be applied to other vehicle-related services involving data transfer as well, including for example, music streaming services (e.g., deciding whether to and how long to buffer before beginning audio playback of music).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A method for providing text-to-speech (TTS) functionality to a telematics unit of a telematics-equipped vehicle in a networked system, the method comprising:

receiving, by a processor of the telematics unit or a remote TTS engine on a remote server, text content to be played back by an audio system of the telematics-equipped vehicle;

determining, by the processor of the telematics unit or the remote TTS engine on the remote server, a TTS rendering process type to be used for the text content from a plurality of TTS rendering process types supported by the networked system, wherein the plurality of TTS rendering process types include:

a local TTS rendering process using a local TTS engine at the telematics-equipped vehicle, a remote TTS rendering process with delayed playback using the remote TTS engine, and a remote TTS rendering process with streaming playback using the remote TTS engine; and causing, by the processor of the telematics unit or the remote TTS engine on the remote server, the text content to be rendered as an audio signal for playback by the telematics-equipped vehicle using the determined TTS rendering process type;

wherein the determining is based on a quality of service (QoS) level corresponding to a location of the vehicle and a future expected location of the vehicle, and wherein during the determining, the TTS rendering process type is specified as:

the local TTS rendering process for a current location corresponding to a first range of QoS levels, the remote TTS rendering process with delayed playback for a current location corresponding to a second range of QoS levels and for an expected transition from a current location corresponding to a third range of QoS levels to a future expected location corresponding to the first or second range of QoS levels;

the remote TTS rendering process with streaming playback for a current location corresponding to the third range of QoS levels when there is not an to an expected transition to a future expected location corresponding to the first or second range of QoS levels.

2. The method according to claim 1, wherein determining the TTS rendering process type to be used is further based on a text-related parameter, the text-related parameter comprising a message type, a message length, or a message classification.

3. The method according to claim 1, wherein determining the TTS rendering process type to be used is further based on a cost-related parameter, the cost-related parameter being associated with a subscriber preference relating to cost of telematics services.

4. The method according to claim 1, wherein determining the TTS rendering process type to be used is further based on a text-related parameter and a cost-related parameter.

5. The method according to claim 1, wherein the remote TTS rendering process with delayed playback comprises determining an amount of content to buffer prior to playback.

6. The method according to claim 1, wherein determining the TTS rendering process type to be used further comprises determining a start time for remote TTS rendering based on a future expected location of the vehicle and network connectivity data associated with the future expected location of the vehicle.

7. A non-transitory computer-readable medium having processor-executable instructions stored thereon for providing text-to-speech (TTS) functionality to a telematics unit of a telematics-equipped vehicle in a networked system, the processor-executable instructions, when executed by a processor of the telematics unit or a remote TTS engine on a remote server, facilitating performance of the following steps:

receiving text content to be played back by an audio system of the telematics-equipped vehicle;

determining a TTS rendering process type to be used for the text content from a plurality of TTS rendering process types supported by the networked system, wherein the plurality of TTS rendering process types include:

a local TTS rendering process using a local TTS engine at the telematics-equipped vehicle, a remote TTS rendering process with delayed playback using the remote TTS engine, and a remote TTS rendering process with streaming playback using the remote TTS engine; and causing the text content to be rendered as an audio signal for playback by the telematics-equipped vehicle using the determined TTS rendering process type;

wherein the determining is based on a quality of service (QoS) level corresponding to a location of the vehicle and a future expected location of the vehicle, and wherein during the determining, the TTS rendering process type is specified as:

the local TTS rendering process for a current location corresponding to a first range of QoS levels, the remote TTS rendering process with delayed playback for a current location corresponding to a second range of QoS levels and for an expected transition from a current location corresponding to a third range of QoS levels to a future expected location corresponding to the first or second range of QoS levels;

the remote TTS rendering process with streaming playback for a current location corresponding to the third range of QoS levels where there is not an to an expected transition to a future expected location corresponding to the first or second range of QoS levels.

8. The non-transitory computer-readable medium according to claim 7, wherein determining the TTS rendering process type to be used is further based on a text-related parameter, the text-related parameter comprising a message type or message length.

9. The non-transitory computer-readable medium according to claim 7, wherein determining the TTS rendering process type to be used is further based on a cost-related parameter, the cost-related parameter being associated with a subscriber preference relating to cost of telematics services.

10. The non-transitory computer-readable medium according to claim 7, wherein determining the TTS rendering process type to be used is further based on a text-related parameter and a cost-related parameter.

11. The non-transitory computer-readable medium according to claim 7, wherein the remote TTS rendering process with delayed playback comprises determining an amount of content to buffer prior to playback.

12. The non-transitory computer-readable medium according to claim 7, wherein determining the TTS rendering process type to be used further comprises determining a start time for remote TTS rendering based on a future expected location of the vehicle and network connectivity data associated with the future expected location of the vehicle.

* * * * *